US012004632B1

(12) United States Patent
McDonald

(10) Patent No.: US 12,004,632 B1
(45) Date of Patent: Jun. 11, 2024

(54) PERSONAL MIRROR APPARATUS HAVING A PLURALITY OF PIVOTALLY INTERCONNECTED MIRROR PANELS AND HANDLE EXTENDING THEREFROM

(71) Applicant: Wendy McDonald, Chicago, IL (US)

(72) Inventor: Wendy McDonald, Chicago, IL (US)

( * ) Notice: Subject to any disclaimer, the term of this patent is extended or adjusted under 35 U.S.C. 154(b) by 0 days.

(21) Appl. No.: 18/131,730

(22) Filed: Apr. 6, 2023

(51) Int. Cl.
*A45D 42/18* (2006.01)

(52) U.S. Cl.
CPC ..... *A45D 42/18* (2013.01)

(58) Field of Classification Search
CPC ..... A45D 42/10; A45D 42/18
See application file for complete search history.

(56) References Cited

U.S. PATENT DOCUMENTS

D552,851 S 10/2007 Abrahamian
D686,323 S 7/2013 Alvi
8,651,676 B2 2/2014 Nottage
10,076,176 B2 9/2018 Yang
2004/0233556 A1 11/2004 La Viola
2005/0270769 A1* 12/2005 Smith ..... A47G 1/24 362/253

FOREIGN PATENT DOCUMENTS

CN 204719306 U * 10/2015
WO WO2009156716 12/2009

* cited by examiner

*Primary Examiner* — Robert J May

(57) ABSTRACT

A personal mirror apparatus for viewing a surface of a body of a user which is obscured from view by the user includes a mirror assembly comprising a plurality of mirror panels. The mirror panels are pivotally interconnected, and each mirror panel of the plurality of mirror panels has a reflective surface and a back surface opposing each other. The mirror assembly is positionable in a use condition wherein the plurality of mirror panels partially bound a region such that the plurality of mirror panels face the region. A light emitting assembly is coupled to the mirror assembly and is positioned to direct light away from the reflective surface of one of the plurality of mirror panels. A mount is attached to the mirror assembly and is positioned on the back surface of the first mirror panel. A handle is coupled to and extends away from the mount.

13 Claims, 6 Drawing Sheets

PERSONAL MIRROR APPARATUS HAVING A PLURALITY OF PIVOTALLY INTERCONNECTED MIRROR PANELS AND HANDLE EXTENDING THEREFROM

BACKGROUND OF THE INVENTION

(1) Field of the Invention

The disclosure relates to mirror devices and more particularly pertains to a new mirror for viewing a surface of a body of a user which is obscured from view by the user.

(2) Description of Related Art Including Information Disclosed Under 37 CFR 1.97 and 1.98

The prior art includes mirror devices of various configurations for viewing obscured areas of the body. Some mirror devices of the prior art include a mirror which is mounted on a handle so that the mirror can be positioned away from a user's hands while the user can manipulate the positioning of the mirror with their hands. The prior art also discloses mirror devices that have multiple mirrors that are orientable in various angles with respect to each other. Such devices include those where the mirrors are pivotally interconnected to each other. The prior art also includes mirror devices that have lighting elements for lighting an area to be seen reflected by the mirror device. However, the prior art does not disclose a mirror device with a plurality of interconnected mirror panels with a lighting assembly and a handle attached to the mirror panels. Such a device provides an alternative to other mirror devices which allows a user to light and view an obscured area of their body while manipulating the position of the device with their hands.

BRIEF SUMMARY OF THE INVENTION

An embodiment of the disclosure meets the needs presented above by generally comprising a mirror assembly comprising a plurality of mirror panels. The mirror panels are pivotally interconnected, and each mirror panel of the plurality of mirror panels has a reflective surface and a back surface opposing each other. The mirror assembly is positionable in a use condition wherein the plurality of mirror panels partially bound a region such that the plurality of mirror panels face the region. A light emitting assembly is coupled to the mirror assembly and is positioned to direct light away from the reflective surface of one of the plurality of mirror panels. A mount is attached to the mirror assembly and is positioned on the back surface of the first mirror panel. A handle is coupled to and extends away from the mount.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
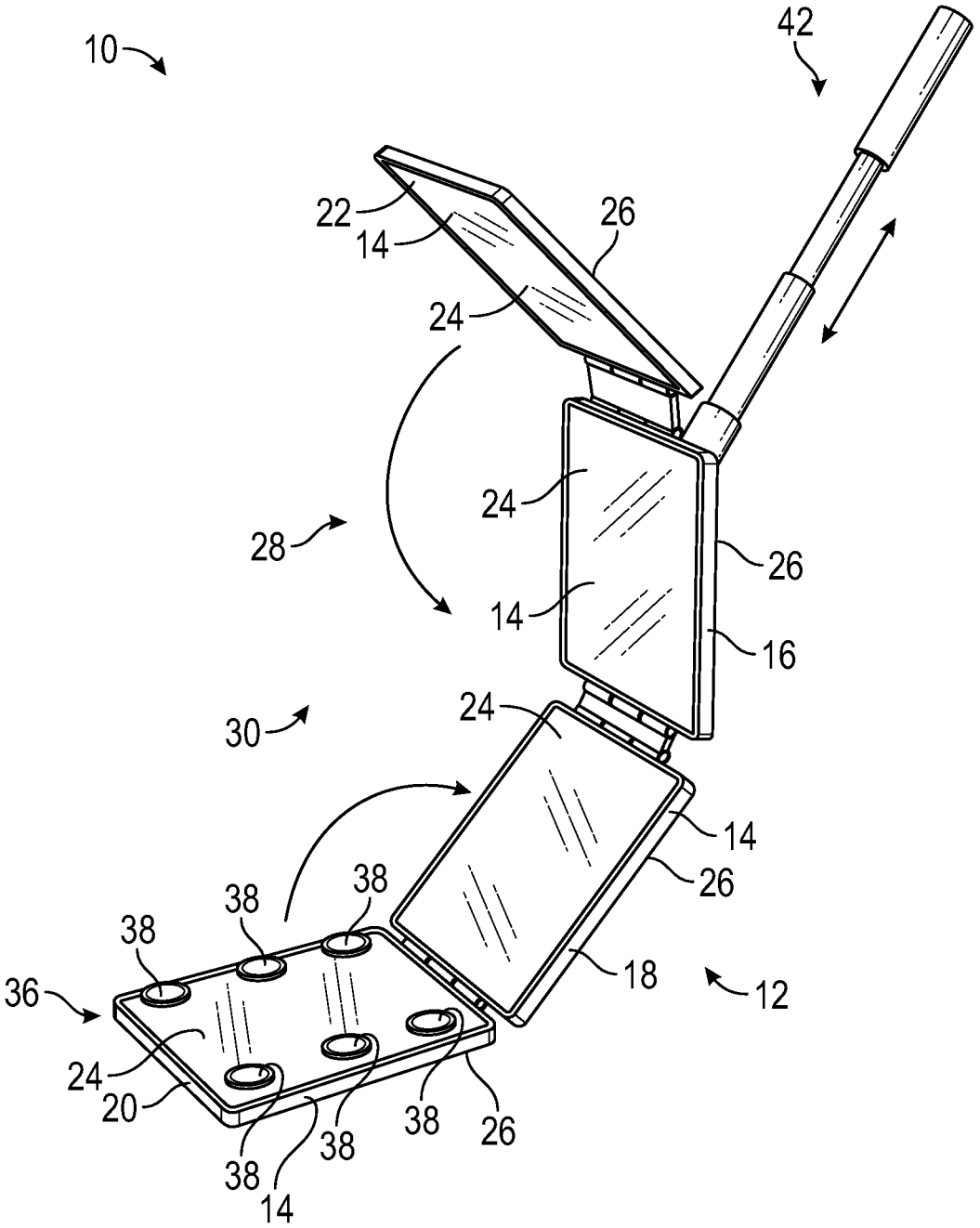
FIG. 1 is a perspective view of a personal mirror apparatus according to an embodiment of the disclosure.
Figure 2:
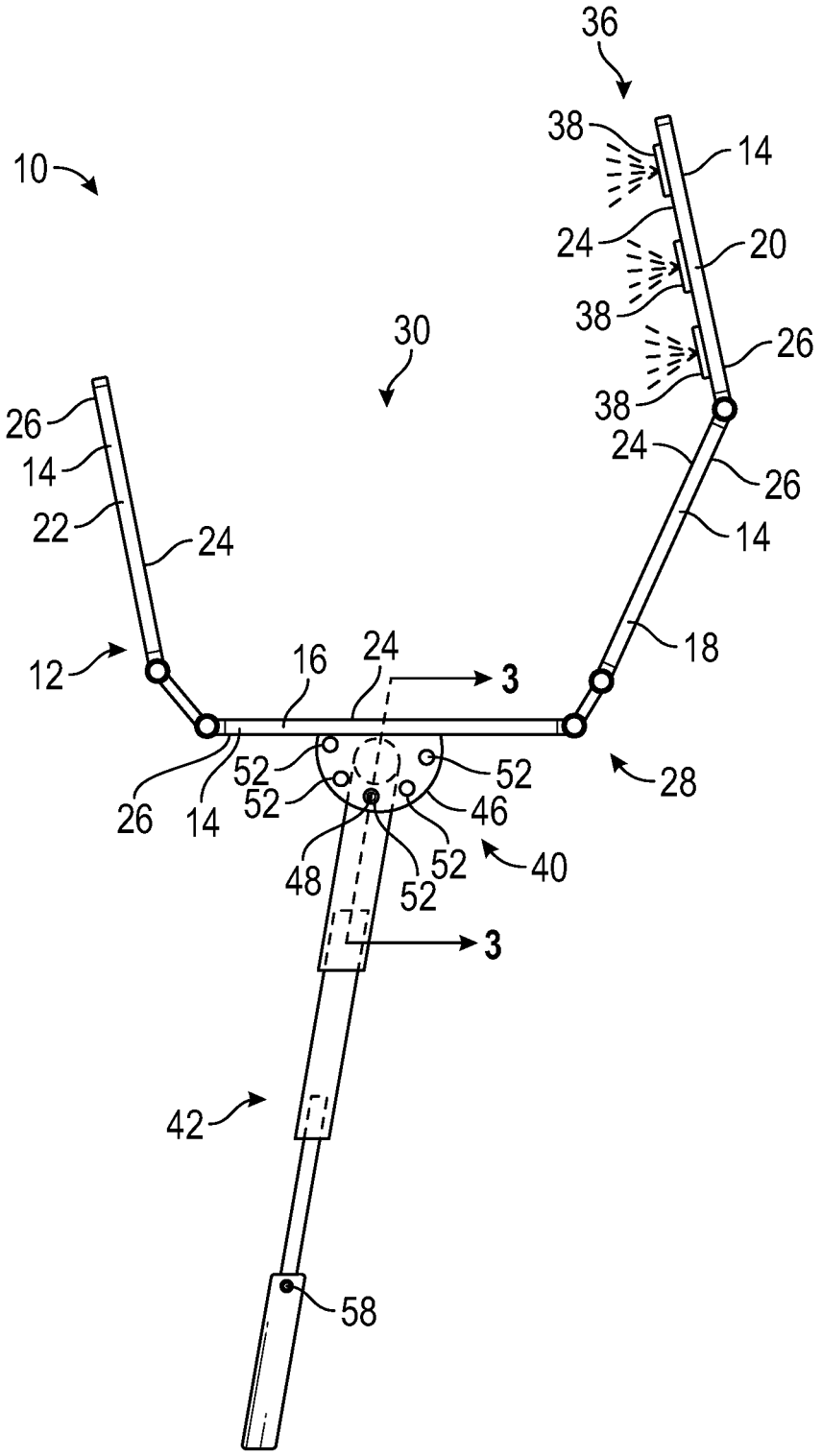
FIG. 2 is a side view of an embodiment of the disclosure.
Figure 3:
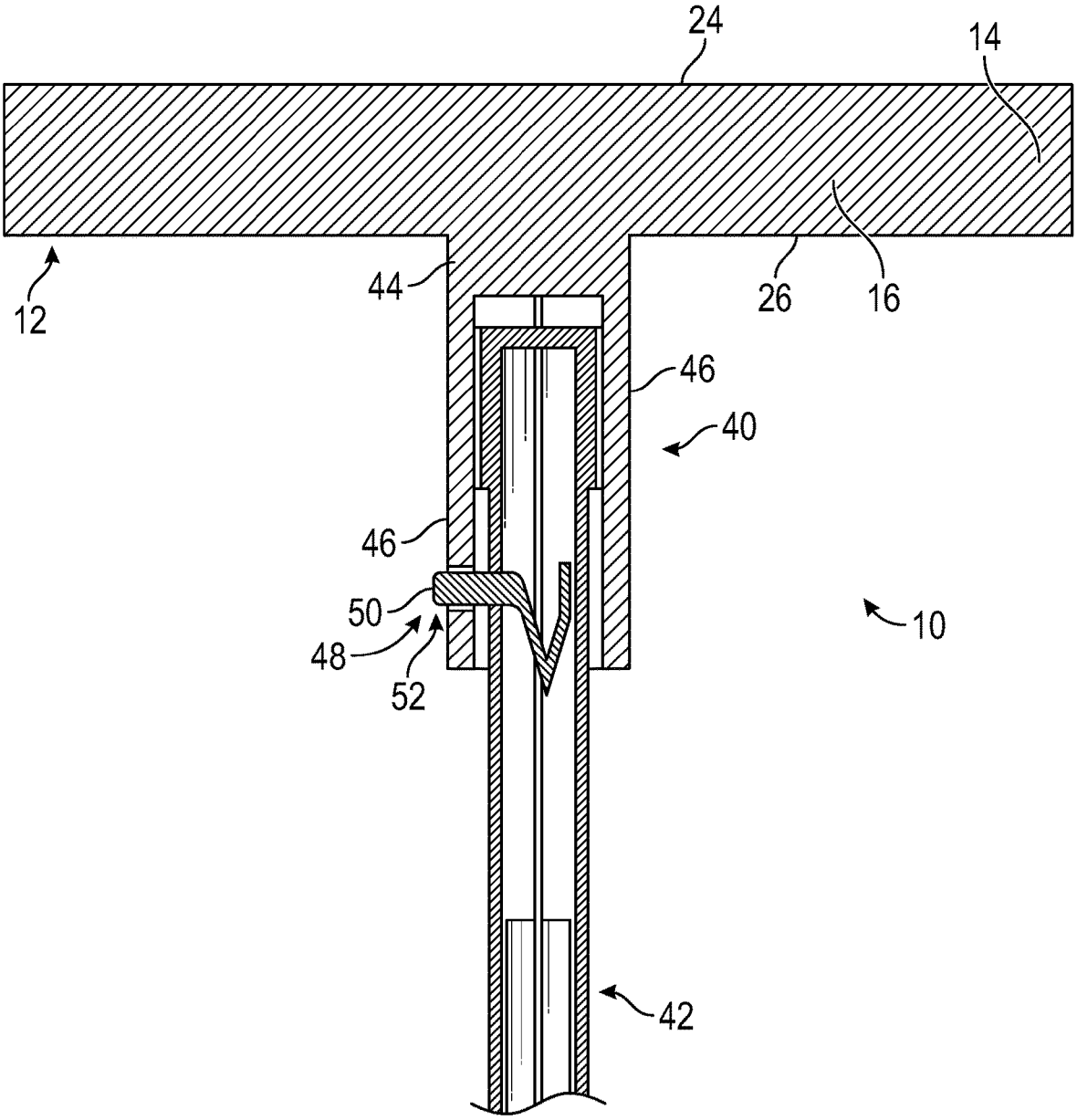
FIG. 3 is a cross-sectional view of an embodiment of the disclosure taken from Arrows 3-3 in FIG. 2.
Figure 4:
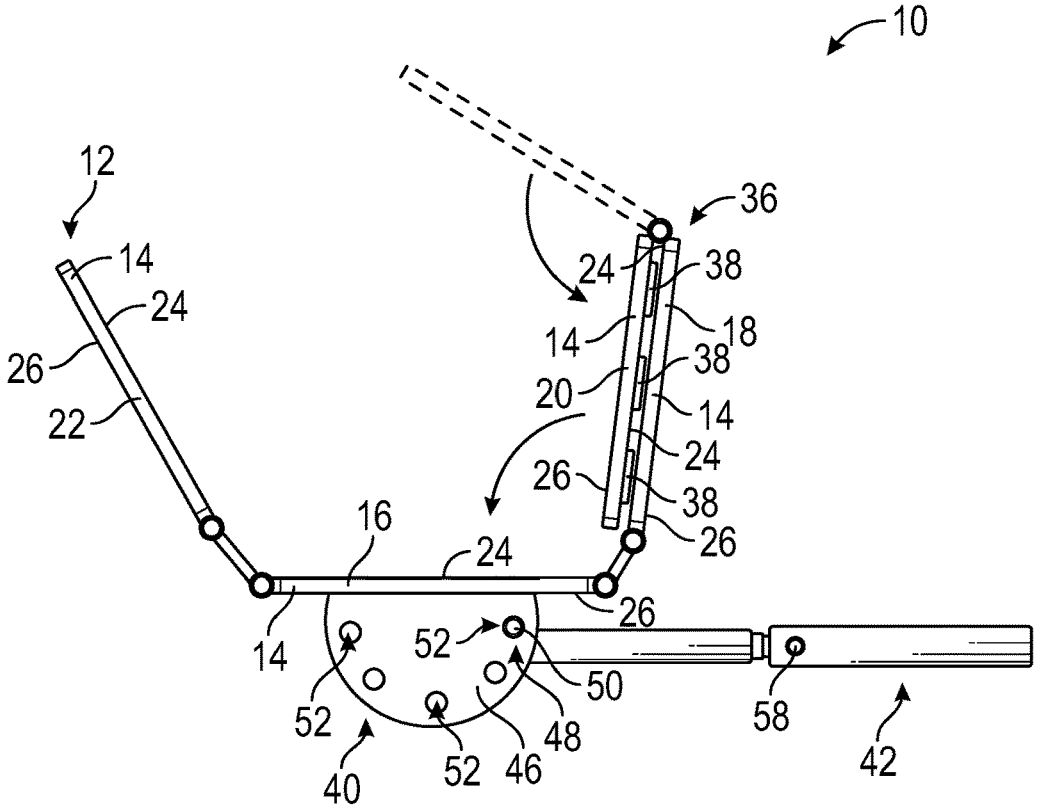
FIG. 4 is a side view of an embodiment of the disclosure.
Figure 5:
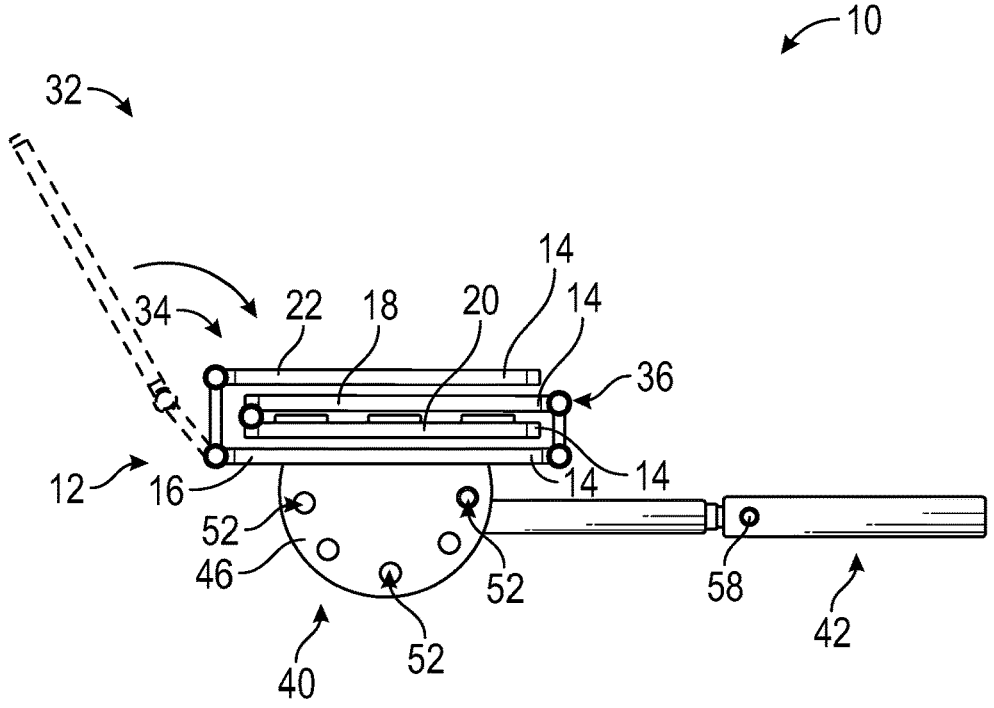
FIG. 5 is a side view of an embodiment of the disclosure.
Figure 6:
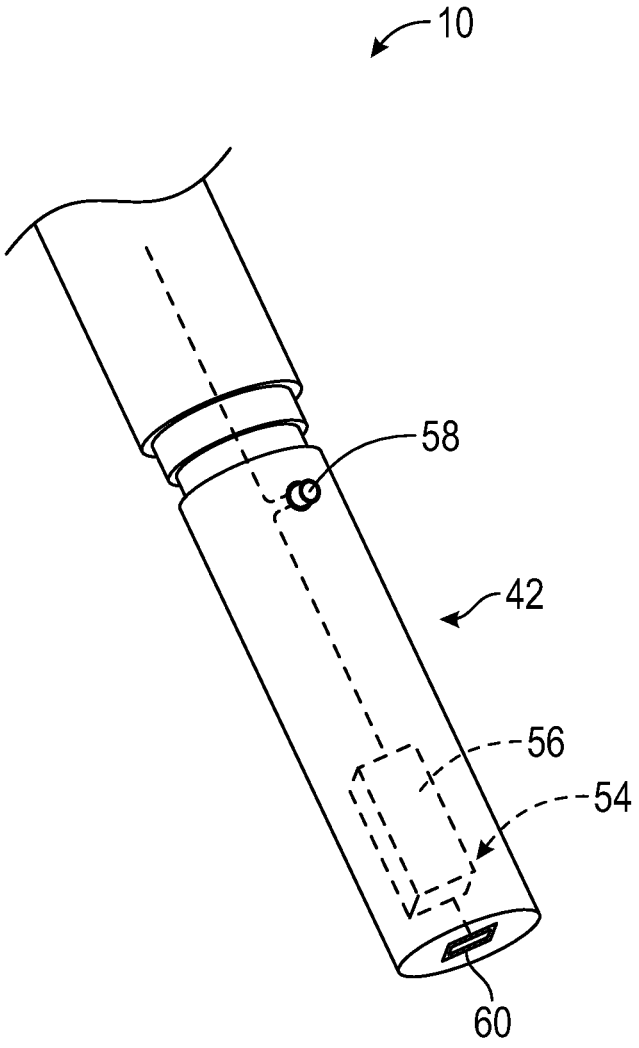
FIG. 6 is a detail view of a portion of a handle of an embodiment of the disclosure.
Figure 7:
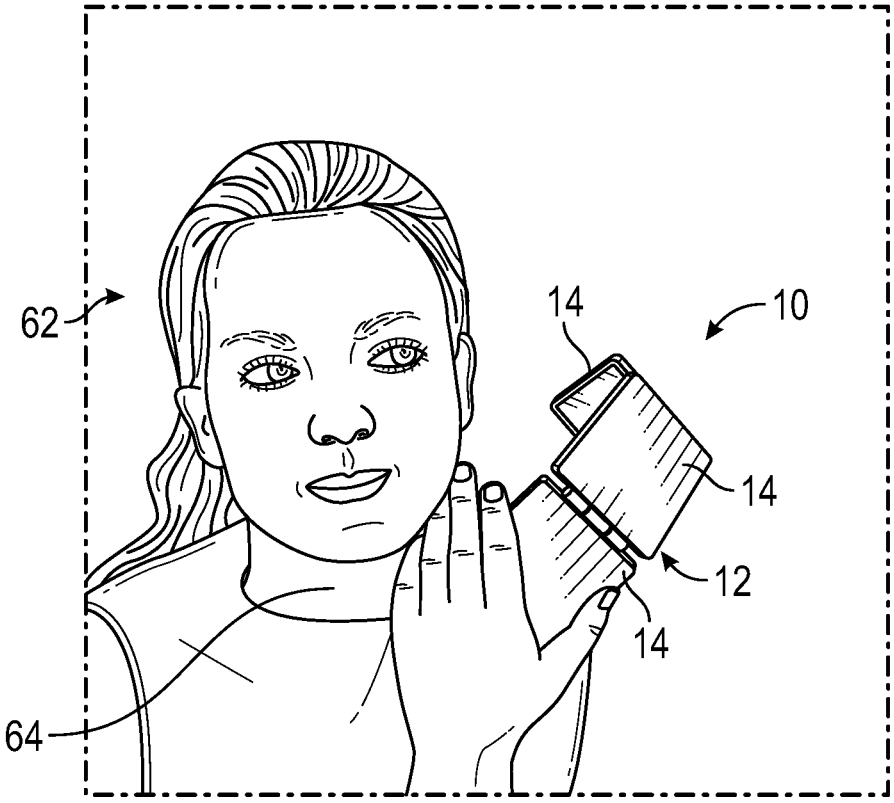
FIG. 7 is an in-use view of an embodiment of the disclosure.

With reference now to the drawings, and in particular to FIGS. 1 through 7 thereof, a new mirror device embodying the principles and concepts of an embodiment of the disclosure and generally designated by the reference numeral 10 will be described.

As best illustrated in FIGS. 1 through 7, the personal mirror apparatus 10 generally comprises a mirror assembly 12 comprising a plurality of mirror panels 14. The mirror panels 14 are pivotally interconnected, and each mirror panel 14 of the plurality of mirror panels 14 has a reflective surface 24 and a back surface 26 opposing each other. The mirror assembly 12 is positionable in a use condition 28 wherein the plurality of mirror panels 14 partially bound a region 30 such that the plurality of mirror panels 14 face the region 30. The mirror assembly 12 is also positionable in a folded condition 32 wherein the plurality of mirror panels 14 form a stack 34. The plurality of mirror panels 14 includes a first mirror panel 16, a second mirror panel 18, a third mirror panel 20, and a fourth mirror panel 22. The second mirror panel 18 is pivotally attached to the first mirror panel 16, and the third mirror panel 20 is pivotally attached to the second mirror panel 18 opposite the first mirror panel 16. The fourth mirror panel 22 is pivotally attached to the first mirror panel 16 opposite the second mirror panel 18. The folded condition 32 of the mirror assembly 12 includes the reflective surface 24 of the first mirror panel 16 facing the back surface 26 of the third mirror panel 20, the reflective surface 24 of the third mirror panel 20 facing the reflective surface 24 of the second mirror panel 18, and the back surface 26 of the second mirror panel 18 facing the reflective surface 24 of the fourth mirror panel 22.

A light emitting assembly 36 is coupled to the mirror assembly 12 and is positioned to direct light away from the reflective surface 24 of one of the plurality of mirror panels 14. The light emitting assembly 36 is positioned on the reflective surface 24 of the third mirror panel 20 and includes a plurality of light emitters 38 which are dispersed adjacent to a peripheral edge of the third mirror.

A mount 40 is attached to the mirror assembly 12 and is positioned on the back surface 26 of the first mirror panel 16. A handle 42 is coupled to and extends away from the mount 40. The handle 42 is pivotable with respect to the mount 40 and is telescopically extendable. The mount 40 includes a base 44 and a pair of sidewalls 46 which is coupled to and extends away from the base 44. The handle 42 is coupled to and positioned between the pair of sidewalls 46. A position lock 48 is engageable with the handle 42 and the mount 40 to secure the handle 42 in one of a plurality of positions with respect to the mount 40. The position lock 48 comprises a locking pin 50 which is coupled to the handle 42 and is biased to engage one sidewall 46 of the pair of sidewalls 46 of the mount 40. The one sidewall 46 has a plurality of openings 52 for receiving the locking pin 50 therethrough.

A power supply 54 is electrically coupled to the light emitting assembly 36 and is mounted to the handle 42. The power supply 54 comprises a battery 56. A switch 58 is electrically coupled to the power supply 54 and the light emitting assembly 36 and is operable to alternately turn the light emitting assembly 36 on and off. The switch 58 is also mounted on the handle 42. A charging port 60 is electrically coupled to the battery 56 for charging the battery 56 and is also positioned on the handle 42.

In use, the mirror assembly 12 is positioned in the use condition 28 and placed such that a surface of a body 64 of a user 62 is viewable by the user 62 as reflected through at least one of the mirror panels 14 of the plurality of mirror panels 14. The handle 42 may be fully extended and positioned in any of the plurality of positions to achieve this placement. For compact storage, the mirror assembly 12 may be folded into the folded condition 32 and the handle 42 may be fully retracted.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A personal mirror apparatus for viewing a surface of a body of a user which is obscured from view by the user, the apparatus comprising:

a mirror assembly comprising a plurality of mirror panels, the plurality of mirror panels being pivotally interconnected, each mirror panel of the plurality of mirror panels having a reflective surface and a back surface opposing each other, the mirror assembly being positionable in a use condition wherein the plurality of mirror panels partially bound a region such that the plurality of mirror panels face the region;

a light emitting assembly being coupled to the mirror assembly, the light, emitting assembly being positioned to direct light away from the reflective surface of one of the plurality of mirror panels;

a mount being attached to the mirror assembly, the mount being positioned on the back surface of the first mirror panel;

a handle being coupled to and extending away from the mount;

wherein the plurality of mirror panels includes a first mirror panel, a second mirror panel being pivotally attached to the first mirror panel, a third mirror panel being pivotally attached to the second mirror panel opposite the first mirror panel, and a fourth mirror panel being pivotally attached to the first mirror panel opposite the second mirror panel; and wherein the light emitting assembly is positioned on the reflective surface of the third mirror panel.

2. The apparatus of claim 1, wherein the mirror assembly is positionable in a folded condition wherein the plurality of mirror panels form a stack.

3. The apparatus of claim 2, wherein the folded condition of the mirror assembly includes the reflective surface of the first mirror panel facing the back surface of the third mirror panel, the reflective surface of the third mirror panel facing the reflective surface of the second mirror panel, and the back surface of the second mirror panel facing the reflective surface of the fourth mirror panel.

4. The apparatus of claim 1, wherein the light emitting assembly including a plurality of light emitters, the plurality of light emitters being dispersed adjacent to a peripheral edge of the third mirror.

5. The apparatus of claim 1, wherein the handle is pivotable respect to the mount.

6. The apparatus of claim 5, further comprising a position lock being engageable with the handle and the mount to secure the handle in one of a plurality of positions with respect to the mount.

7. The apparatus of claim 6, wherein:

the mount includes a base and a pair of sidewalls being coupled to and extending away from the base, the handle being coupled to and positioned between the pair of sidewalls; and the position lock comprises a kicking pin being coupled to the handle and being biased to engage one sidewall of the pair of sidewalls of the mount, the one sidewall having a plurality of openings for receiving the locking pin therethrough.

8. The apparatus of claim 1, wherein the handle is telescopically extendable.

9. The apparatus of claim 1, further comprising a power supply being electrically coupled to the light emitting assembly, the power supply being mounted to the handle.

10. The apparatus of claim 9, wherein the power supply comprises a battery.

11. The apparatus of claim 10, further comprising a charging port being electrically coupled to the battery for charging the battery, the charging port being positioned on the handle.

12. The apparatus of claim 9, further comprising a switch being electrically coupled to the power supply and the light emitting assembly, the switch being operable to alternately turn the light emitting assembly on and off, the switch being mounted on the handle.

13. A personal mirror apparatus for viewing a surface of a body of a user which is obscured from view by the user, the apparatus comprising:

a mirror assembly comprising a plurality of mirror panels, the plurality of mirror panels being pivotally interconnected, each minor panel of the plurality of minor panels having a reflective surface and a back surface opposing each other, the mirror assembly being positionable in a use condition wherein the plurality of mirror panels partially bound a region such that the plurality of mirror panels face the region, the mirror assembly being positionable in a folded condition wherein the plurality of minor panels form a stack, the plurality of mirror panels including:

a first mirror panel;

a second mirror panel being pivotally attached to the first mirror panel;

a third mirror panel being pivotally attached to the second mirror panel opposite the first mirror panel; and a fourth mirror panel being pivotally attached to the first mirror panel opposite the second mirror panel;

the folded condition of the mirror assembly including the reflective surface of the first mirror panel facing the back surface of the third mirror panel, the reflective surface of the third mirror panel facing the reflective surface of the second mirror panel, and the back surface of the second mirror panel facing the reflective surface of the fourth mirror panel;

a light emitting assembly being coupled to the mirror assembly, the light emitting assembly being positioned to direct light away from the reflective surface of one of the plurality of mirror panels, the light emitting assembly being positioned on the reflective surface of the third mirror panel, the light emitting assembly including a plurality of light emitters, the plurality of light emitters being dispersed adjacent to a peripheral edge of the third mirror;

a mount being attached to the mirror assembly, the mount being positioned on the back surface of the first mirror panel;

a handle being coupled to and extending away from the mount, the handle being pivotable with respect to the mount, the handle being telescopically extendable;

the mount including a base and a pair of sidewalls being coupled to and extending away from the base, the handle being coupled to and positioned between the pair of sidewalls;

a position lock being engageable with the handle and the mount to secure the handle in one of a plurality of positions with respect to the mount, the position lock comprising a locking pin being coupled to the handle and being biased to engage one sidewall of the pair of sidewalls of the mount, the one sidewall having a plurality of openings for receiving the locking pin therethrough;

a power supply being electrically coupled to the light emitting assembly, the power supply being mounted to the handle, the power supply comprising a battery;

a switch being electrically coupled to the power supply and the light emitting assembly, the switch being operable to alternately turn the light emitting assembly on and off, the switch being mounted on the handle; and a charging port being electrically coupled to the battery for charging the battery, the charging port being positioned on the handle.

* * * * *